United States Patent [19]

McQueen

[11] 4,422,254

[45] Dec. 27, 1983

[54] SAFETY MECHANISM FOR FIREARMS

[76] Inventor: Sidney J. McQueen, 414 Coors Blvd. SW., Albuquerque, N. Mex. 87105

[21] Appl. No.: 346,635

[22] Filed: Feb. 8, 1982

[51] Int. Cl.[3] ..... F41C 17/00

[52] U.S. Cl. ..... 42/1 Y; 42/70 D

[58] Field of Search ..... 42/1 Y, 70 C, 70 D, 42/70 E

[56] References Cited

U.S. PATENT DOCUMENTS

| | | | |
|---|---|---|---|
| 547,454 | 10/1895 | Schmeisser | 42/1 Y |
| 965,386 | 7/1910 | Hansen | 42/1 Y |
| 2,195,693 | 4/1940 | Clifton | 42/1 Y |
| 2,401,482 | 6/1946 | Hendey | 42/1 Y |
| 2,525,886 | 10/1950 | Fraser | 42/1 Y |

*Primary Examiner*—Charles T. Jordan

*Attorney, Agent, or Firm*—Walter R. Keller

[57] ABSTRACT

A safety mechanism for firearms having a sear pivoting in front of a trigger, wherein the safety mechanism consists of a safety shaft which is rotatably installed transversely to the axis of the barrel; said safety shaft providing positive safe and fire positions by blocking or freeing sear movement; and said safety mechanism also consisting of a safety channel which is affixed to the safety shaft, said safety channel acting as the positioning lever for the safety shaft; and said safety channel being a visible indicator of the position of the safety channel as well as a dust cover and said safety channel blocking access to the trigger when in the safe position; and wherein the safety mechanism can be positioned in the firing mode, and access to the trigger provided by one motion of the safety channel unilaterally with intentionally positioning the trigger finger on the trigger ready to fire.

3 Claims, 4 Drawing Figures

SAFETY MECHANISM FOR FIREARMS

BACKGROUND

1. Field of the Invention

This invention relates generally to safety mechanisms for fire arms, and particularly to safety mechanisms for weapons having a sear pivoted forward of the trigger. A secondary relationship of the invention is to serve as a protective cover for the trigger and sear mechanism, protecting against dust, dirt, the elements, and other foreign objects.

2. Description of Prior Art

Requirements of safety mechanisms for firearms have varied from time to time; however, one requirement usually common is that the condition, safe or unsafe, be highly visible, in order that persons adjacent to the weapon can readily ascertain its condition. Combat weapons, in addition, should be easily, and quickly changeable from a safe condition to a ready to fire condition with an absolute minimum of time and effort, but should require a positive intent to change condition, rather than the condition being changeable by inadvertance or inattention. The above requirements have generally resulted in rods or shafts which push-pull transverse to the axis of the weapon barrel, or slide levers along the axis of the barrel. These types of safety usually required an action on the part of the firer independent of and seperate from the intention of firing in order to change the condition of the weapon from safe to ready to fire.

SUMMARY OF THE INVENTION

This invention is adaptable to almost any weapon having its sear pivoting in front of the trigger. This invention has as its primary objective, the providing of a safing capability, the capability for fire arms to be placed in a safe or in a ready to fire condition. The secondary objective is to provide the safing capability as simply as possible, yet making the condition of the weapon as visible as possible. A further objective of the invention is to make the changing of the condition of the weapon from safe to ready to fire as nearly as possible a part of the natural motion of the firer, so that there is no wasted motion or time, in a combat situation, changing the condition of the weapon. A further objective of the invention, is to provide, at minimum weight, the aforesaid safing capability which has the added function of protecting vital parts of the weapon from dust, dirt, and foreign objects, and in the safe condition blocking access to the trigger of the weapon.

DESCRIPTION OF THE PREFERRED EMBODIMENT

Figure 1:
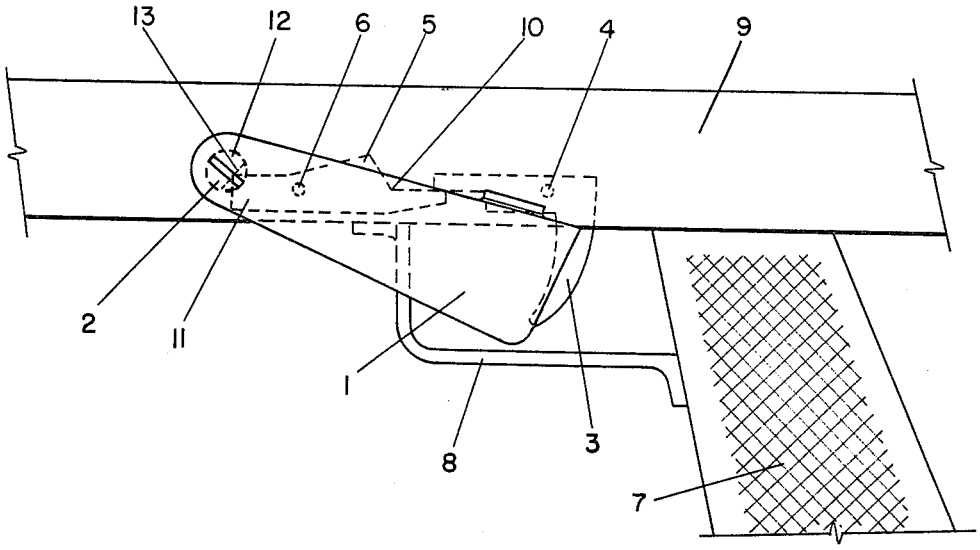
FIG. 1 is a plan view of the invention installed in a firearm.
Figure 2:
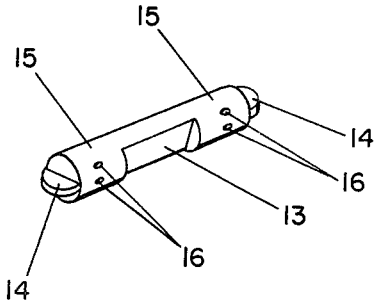
FIG. 2 is an isometric view of the safety shaft.
Figure 3:
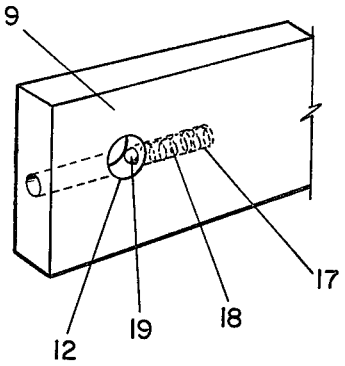
FIG. 3 is an isometric view of a side plate.

FIG. 1, shows the invention, in relation to other parts of a weapon. The invention is shown to be a safety channel 1 and a safety shaft 2. Also shown in FIG. 1 are the trigger 3, trigger pivot 4, sear 5, sear pivot 6, pistol grip 7, trigger guard 8, and one of the two side plates 9 of the firearm. Normally, when the trigger 3 is squeezed the trigger 3 is rotated, which in turn causes the sear 5 to pivot. As the trigger 3 pivots counter clockwise, the sear 5 pivots clockwise. The sear 5 has a trigger end 10 and a safety end 11. The sear pivot 6 is disposed between the trigger end 10 and the safety end 11, however depending on the design the sear pivot 6 may be disposed more toward the safety end 11. In the vicinity of the safety end 11 through and perpendicular to the side plates 9, are drilled two safety holes 12, one coaxial with the other and one in each side plate 9. The safety shaft 2 shown in FIG. 2 is generally cylindrical, with a safety flat 13 in its midsection. The safety shaft 2 is sized generally in diameter to rotatably insert in the safety holes 12. The safety shaft 2 is of sufficient length to protrude slightly through each safety hole 12. On each end of the safety shaft 2, an ear 14 protrudes. The ears 14 are generally flat and may be semicircular with a diameter of that of the safety shaft 2. The plane of the ears 14 is perpendicular to the plane of the flat 13. The safety shaft 2 has two cylindrical sections 15, each cylindrical section being between the safety flat 13 and one of the ears 14. In each of the cylindrical sections 15 is drilled two small hemispherical detents 16. One of the detents 16 in each cylindrical section 15 is drilled on a radius of the safety shaft 2 perpendicular to the planes of the ears 14 and the safety flat 13. The other detent 16 in each cylindrical section 15 is drilled on a radius of the safety shaft of 35° to 40° from the first detent 16 on each cylindrical section 15. As shown in FIG. 3, into each side plate 9, is drilled a positioning bore 17, said positioning bore 17 being on a radius of the safety hole 12. The positioning bore 17 is sized to accept a biasing spring 18 and a positioning ball 19. The positioning ball 19 is shown to be a small ball bearing type device; however as a design choice it could just as well be a conical shaped pin (not shown) and the detents could be conical. The positioning ball 19 is sized and shaped to mate with the detents 16, and functions to provide a biasing force which tends to retain the safety shaft 2 in the position selected. There are numerous types of devices which will accomplish the function of the detents 16 and the positioning ball 19, and the description of the ball 19 detent 16 type is intended to be illustrative only, and not limiting.

Figure 4:
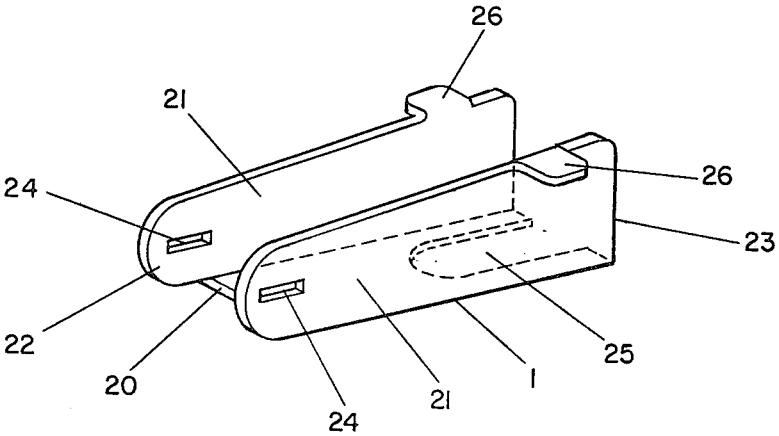
FIG. 4 is an isometric view of the safety channel.

The safety channel 1 shown in FIG. 4, is shaped generally as a rectangular channel having a back 20, two runners 21, a mounting end 22, and a free end 23. At the mounting end 22, the runners 21, which are at right angles to the back 20, protrude beyond the back 20. In each runner 21 in the position protruding beyond the back 20 is a horizontal slot 24. Each horizontal slot 24 is generally rectangular and sized to slideably accept one of the ears 14. Toward the free end 23 of the safety channel 1, a trigger clearance slot 25 is cut into the back 20 of the safety channel 1. The trigger clearance slot 25 is of any convenient shape, so long as it allows movement, to be subsequently explained, of the safety channel 1 without interfering with the trigger 3. On the extremities of the runners 21 toward the free end 23 in any convenient design and shape are finger tabs 26. The finger tabs 26 are to provide easy finger motion to move the safety channel 1.

To explain the functioning of the invention, the following discussion will be refering primarily to FIG. 1. The invention is installed in the weapon during assembly. The safety shaft 2 is installed through the safety holes 12 after the biasing springs 18 and positioning balls 19 are installed in the side plates 9. The safety channel 1 is installed by snapping the runners 21 over the ears 14. The trigger guard 8 is lastly installed. Thus assembled, the safety channel 1 is inside the trigger guard 8; and in the ready-to-fire position the safety channel 1 is fully up against and straddling the side plates 9. In this position the safety flat 13 is vertical, thereby permitting unobstructed pivotal movement of the sear 5. To put the weapon in the safe position the safety channel 1 is moved down against the trigger guard 8, only after the bolt of the weapon is manually retracted to the cocked, ready-to-fire position. The safety channel 1 thus physically blocks access to the trigger 3, and the position of the safety channel 1 is highly visible. When the safety channel 1 is moved downward the safety shaft 2 is rotated so that the safety flat 13 bears against the top corner of the sear 5 blocking and preventing the sear 5 from pivoting. When the safety shaft 2 is pivoted to either the ready-to-fire or the safe position, the positioning balls 19 are forced by the biasing spring 18 into one set of detents 16, retaining the safety channel 1 in the selected position. The geometry regarding the length of the safety channel 1, and the shape of the trigger guard 8 determine the angle through which the safety channel 1 can pivot in moving from safe to fire. In this description, the safety channel 1 can pivot through a thirty degree angle. Thus, in either the safe or fire position, the positioning balls 19 do not precisely match the detents 16. Instead the positioning balls 19 and the detents 16 are mismatched approximately five degrees in order that the biasing spring 18 and the positioning balls 19 apply a positive force tending to retain the safety shaft 2 and the safety channel 1 in the selected position.

In one movement the person intending to fire the weapon can press on the underside of the back 20 of the safety channel 1, moving the safety channel 1 from the safe position to the fire position, which exposes the trigger 3, allowing the firer to place his trigger finger in contact with the trigger. Simultaneously the movement of the safety channel 1 rotates the safety shaft 2, unblocking the sear 5. Thus, in combat situations the weapon can be carried constantly in the safe position, yet when required no extra time or motion is necessary to place the weapon in a condition to fire and to immediately fire the weapon.

It is realized that the geometry which controls the pivoted motion of the safety channel 1 and the rotation of the safety shaft 2 can be varied substantially by design choice. The corresponding location of the detents 16 on the safety shaft 1 must match the rotation of the safety shaft 2. The choice of thirty degrees, aforementioned, is intended to be illustrative, and not limiting. However, the mismatch of the detents 16 and the positioning balls 19 is intentional, and can be used with any geometry with a corresponding change of the relative position of the detents 16 to each other on the safety shaft 2.

I claim:

1. A safety mechanism for firearms having a pivoting sear, said sear being forward of a trigger, said safety mechanism comprising:

a safety shaft having a safety flat, said safety shaft being rotatably installed through safety holes in side plates of the firearm, said safety holes being adjacent to a safety end of the sear; and said safety shaft having on each end an ear, said ear being essentially flat, and the plane of each ear being perpendicular to the plane of the safety flat; and a safety channel having a back and two runners, a mounting end and a free end, and said safety channel having horizontal slots in the runners at the mounting end, said horizontal slots being sized to mate with the ears, and said safety channel having a trigger clearance slot in its back, and said safety channel having finger tabs on the runners at the free end to permit one-motion-movement of the safety channel and insertion of a trigger finger to the trigger, and said runners having a design and shape so that they will block access to the trigger; and wherein the safety channel is mated to the safety shaft so that when the mechanism is in the safe position, the safety flat blocks movement of the sear.

2. The safety mechanism of claim 1 wherein the safety shaft has two cylindrical sections, and wherein each of the side plates of the weapon have a positioning bore, and wherein a positioning means is installed in the positioning bore, and each cylindrical section of the safety shaft has two positioning detents, wherein the positioning means function with the detents to bias the safety mechanism in a selected position.

3. The safety mechanism of claim 2 wherein the detents are hemispherical, and the positioning means comprises biasing springs and spherical positioning balls, and wherein one detent on each cylindrical section is centered on a radius of the safety shaft perpendicular to the safety flat, and the other detent on each cylindrical section is centered on a radius of the safety shaft approximately five degrees from the safe position.

* * * * *